US009309089B2

(12) United States Patent
Annen et al.

(10) Patent No.: US 9,309,089 B2
(45) Date of Patent: Apr. 12, 2016

(54) FAULT DIAGNOSIS OF AN ELEVATOR INSTALLATION

(71) Applicant: Inventio AG, Hergiswil NW (CH)

(72) Inventors: Mirco Annen, Kussnacht a/Rigi (CH); Thomas Neuenschwander, Aarau (CH); Christian Studer, Luzern (CH); Hans Kocher, Udligenswil (CH)

(73) Assignee: Inventio AG, Hergiswil (CH)

( * ) Notice: Subject to any disclaimer, the term of this patent is extended or adjusted under 35 U.S.C. 154(b) by 664 days.

(21) Appl. No.: 13/714,517

(22) Filed: Dec. 14, 2012

(65) Prior Publication Data

US 2014/0008152 A1 Jan. 9, 2014

(30) Foreign Application Priority Data

Dec. 14, 2011 (EP) ..... 11193507

(51) Int. Cl.

| | |
|---|---|
| ***B66B 1/34*** | (2006.01) |
| ***B66B 3/00*** | (2006.01) |
| ***B66B 5/00*** | (2006.01) |
| ***B66B 5/02*** | (2006.01) |

(52) U.S. Cl.

CPC ..... *B66B 3/00* (2013.01); *B66B 5/0025* (2013.01); *B66B 5/0037* (2013.01); *B66B 5/02* (2013.01)

(58) Field of Classification Search

CPC ..... B66B 3/00; B66B 5/0025; B66B 5/0037; B66B 5/02

USPC ..... 187/247, 277, 289, 293, 391, 393

See application file for complete search history.

(56) References Cited

U.S. PATENT DOCUMENTS

| | | | | |
|---|---|---|---|---|
| 4,512,442 | A * | 4/1985 | Moore et al. | 187/393 |
| 5,064,026 | A * | 11/1991 | Nagata et al. | 187/391 |
| 5,522,480 | A * | 6/1996 | Hofmann | 187/391 |
| 6,439,350 | B1 * | 8/2002 | Lence Barreiro et al. | 187/391 |
| 6,854,565 | B2 * | 2/2005 | Perala et al. | 187/393 |
| 7,143,001 | B2 * | 11/2006 | Karasek | 702/141 |
| 7,484,598 | B2 * | 2/2009 | Tyni et al. | 187/393 |
| 7,721,852 | B2 * | 5/2010 | Ishioka et al. | 187/391 |
| 7,823,706 | B2 * | 11/2010 | Tyni et al. | 187/393 |
| 8,418,815 | B2 * | 4/2013 | Encinas Carreno et al. | 187/390 |
| 8,540,057 | B2 * | 9/2013 | Schuster et al. | 187/391 |
| 8,893,858 | B2 * | 11/2014 | Shi et al. | 187/391 |

FOREIGN PATENT DOCUMENTS

| | | | |
|---|---|---|---|
| JP | 10059645 | A | 3/1998 |
| JP | 2005247468 | A | 9/2005 |
| WO | 2009/126140 | A1 | 10/2009 |
| WO | 2009/150251 | A2 | 12/2009 |

* cited by examiner

*Primary Examiner* — Anthony Salata

(74) *Attorney, Agent, or Firm* — Fraser Clemens Martin & Miller LLC; William J. Clemens

(57) ABSTRACT

An elevator installation includes a sensor by which vibrations generated during operation of the elevator installation are detectable and an evaluating circuit, which is connected with the sensor and by which the vibrations detected by the sensor can be evaluated. The detected vibrations can be compared by means of the evaluating circuit with a predeterminable operating value and a predeterminable threshold value.

10 Claims, 3 Drawing Sheets

A - THRESHOLD VALUE FOR FREQUENCY BAND 1297-1557 HZ

B - THRESHOLD VALUE FOR FREQUENCY BAND 1297-1557 HZ

FAULT DIAGNOSIS OF AN ELEVATOR INSTALLATION

CROSS-REFERENCE TO RELATED APPLICATION

This application claims priority to European Patent Application No. 11193507.8, filed Dec. 14, 2011, which is incorporated herein by reference.

FIELD

The present disclosure relates to fault diagnosis of an elevator installation.

BACKGROUND

An elevator installation comprises movable mechanical components such as a drive, cage and shaft doors, cage door drive, a cage door closing mechanism and guide rollers or guide shoes. Individual components are serviced at regular intervals in time and kept serviceable. The cost for such maintenance operations can be relatively inefficient, since the maintenance intervals are sometimes fixedly preset and are not necessarily oriented to the effective utilization of an actual elevator installation and the components thereof.

A possible indicator for the degree of wear of a moving mechanical component is represented by the degree of vibrations. In normal permissible operation a certain degree of vibrations is not exceeded. With progressive wear of a component the vibrations sometimes noticeably increase. If a predeterminable degree of vibrations is exceeded, then the point in time has been reached to restore the component to serviceability or to exchange it.

Vibrations propagate as sonic or solid-borne sound waves and are detectable by means of a sensor. As sonic waves there are to be understood here waves which propagate in a gaseous medium such as air and by solid-borne sound waves there are to be understood here waves which propagate in a solid medium such as steel or iron. Sensors designed as microphones, acceleration pick-ups or voltage measuring sensors are suitable for detection of sonic waves and solid-borne sound waves. An evaluating circuit is connected with one or more sensors. The evaluating circuit and at least one associated sensor form a monitoring unit. The evaluating circuit comprises a processor by which the evaluating circuit evaluates the detected sonic waves or solid-borne sound waves. The detected sonic waves or solid-borne sound waves can be evaluated in the evaluating circuit with respect to the amplitude and frequency thereof and compared with a predetermined value. Conclusions about the functional integrity of the elevator installation and its components can be made therefrom. In the case of exceeding a specific threshold value, a change-of-state alarm can be triggered.

SUMMARY

Some embodiments comprise a monitoring unit for monitoring the components of an elevator installation, possibly by detecting and evaluating vibrations.

In particular embodiments, an elevator installation comprises a sensor and an evaluating circuit. Vibrations generated during operation of the elevator installation are detectable by the sensor. The evaluating circuit is connected with the sensor. The vibrations detected by the sensor can be evaluated by the evaluating circuit. The detected vibrations can be compared by means of the evaluating circuit with a predeterminable operating value and a predeterminable threshold value.

The operating value represents a value of vibrations which occur in acceptable normal operation of the elevator installation. The threshold value, thereagainst, represents a value of vibrations which is unacceptable.

In disturbance-free operation with intact functional integrity of the components the generated vibrations lie in a characteristic frequency range and/or amplitude range. In the case of progressive wear and ageing of the components, this frequency range or amplitude range correspondingly changes. These changes in vibration behavior can be detected by the sensor via sonic waves or solid-borne sound waves.

The vibrations are picked up by the sensor as sonic waves or solid-borne sound waves, passed on to the evaluating circuit and spectrally evaluated there. This means that the vibrations are evaluated with respect to amplitude and frequency. The thus-evaluated vibrations are compared with the operating value and the threshold value. The operating value represents a vibration value such as usually occurs in normal operation of the elevator installation. By contrast, the threshold value represents an impermissible vibration value which indicates faulty functioning or excessive wear of a component. The evaluating circuit has for this evaluation at least one processor which undertakes the spectral analysis and the value comparison and a memory unit in which the operating value and the threshold value are stored.

A possible advantage of this two-stage value comparison resides in establishing the operating value, since it can be ascertained by that without feedback from the elevator control whether the elevator installation is in operation or at standstill. This can be advantageous in a case of retrofitting to elevator installations. Thus, for example, the evaluating circuit during standstill of the elevator installation can independently decide whether components of the monitoring unit which are not needed can be placed in a standby mode and awakened from the standby mode again only when the evaluating circuit ascertains an operating value.

In a further aspect a quality characteristic can be calculated by means of the evaluating circuit from the comparison of the vibrations with the operating value and threshold value. The quality characteristic is calculated from the ratio between the period of time in which the threshold value is reached or exceeded and the period of time in which the operating value is reached or exceeded. The evaluating circuit compares this quality characteristic with a predeterminable critical quality characteristic. The critical quality characteristic is possibly filed in the memory unit. If the critical quality characteristic is reached or exceeded, then a state alarm can be triggered. The change-of-state alarm indicates that at least one component of the monitored elevator installation is to be replaced or repaired.

Thanks to calculation of the quality characteristic and the comparison with a critical quality characteristic, erroneous triggerings of the change-of-state alarm can be largely avoidable, since causes occurring once, such as an emergency stop or movements of passengers in the cage which lead to vibrations lying above the threshold value, can be filtered out over time by the evaluation of the threshold value. Such unique events thus do not automatically lead to an undesired change-of-state alarm. It can also be ensured that during operation of the elevator installation only vibrations lying above the threshold value over a longer period of time trigger a change-of-state alarm.

In a further aspect a change-of-state alarm can be triggered in the case of exceeding the operating value for a predeterminable period of time. The evaluating circuit can thus test the functional capability of the sensor and the connection with the sensor, since each elevator installation has a specific use characteristic. Thus, an elevator installation in an office building is continuously used during the working day and is stationary at night and at weekends apart from individual journeys. Based on that, it can be assumed that the elevator installation over a weekend is stationary for approximately 62 hours, namely Friday night from about 1800 hours to Monday morning at about 0800 hours. On weekdays standstill time can be correspondingly reduced to approximately 14 hours. In a case of a larger dwelling with numerous apartments, thereagainst, the elevator installation is typically constantly used on a daily basis, thus also at the weekend over the day until in the latter part of the evening. Longer standstill times are primarily to be expected over the night between approximately 2200 and 0600 hours. Accordingly, in the case of a larger dwelling the standstill times are generally at most approximately 8 hours. The evaluating circuit can now be configured so that if vibration signals are not received by an associated sensor for a specific time period of approximately 8, 14 or more hours, a change-of-state alarm is triggered.

In this form of change-of-state alarm the reason for triggering, namely the failure of the sensor or the interruption of a connection with the sensor, can also be communicated, which simplifies localization of the disturbance for a maintenance engineer.

In another embodiment the evaluating unit comprises a time data unit. The evaluating circuit can thus preset the time duration up to triggering of a change-of-state alarm on the basis of absence of the operating value in dependence on the time of day and/or date. Thus, a state-change alarm can be triggered over the day in a strongly frequented elevator installation when the operating value is fallen below during at least one hour. In a smaller dwelling, thereagainst, triggering of a change-of-state alarm can take place only after several weeks, since the elevator installation can, for example, be at standstill during the summer holidays for a longer period of time.

Yet a further aspect relates to establishing the operating value by means of a learning travel of the elevator installation. This learning travel is performed after installation of the evaluating circuit and the associated sensor. In that case, the sensor picks up vibrations generated during this learning travel and the evaluating circuit stores these vibrations as operating value in the memory unit.

A possible advantage in the case of detection of the operating value by means of a learning travel resides in the fact that always the same monitoring unit, consisting of sensor and evaluating circuit, can be installed regardless of the type of elevator installation. This can reduce the co-ordination outlay in configuring and ordering a monitoring unit. In addition, mounting of a monitoring unit with an incorrectly filed operating value can be excluded.

The operating value can alternatively be filed in advance in the memory unit of the evaluating circuit in dependence on the type of elevator installation. In that case, the learning travel is redundant.

The evaluating circuit possibly calculates the threshold value after detection of the operating value by means of the learning travel. In that case, the operating value serves as a starting position. The amplitudes, which are recorded for the operating value, of the frequencies in the spectral analysis are in that case multiplied by a predeterminable factor. Finally, the calculated threshold value is stored in the memory unit.

The threshold value can alternatively be filed in advance in the memory unit of the evaluating circuit in dependence on the type of elevator installation.

According to a further aspect of the method the elevator installation is provided for a maintenance operation when a change-in-state alarm occurs. In that case a maintenance engineer is notified to service the elevator installation. This can increase the efficiency of the maintenance operations, since the maintenance operations are carried out only when a component is actually to be serviced or exchanged.

BRIEF DESCRIPTION OF THE DRAWINGS

The disclosed embodiments are further described in the following drawings, in which.

DETAILED DESCRIPTION

Figure 1:
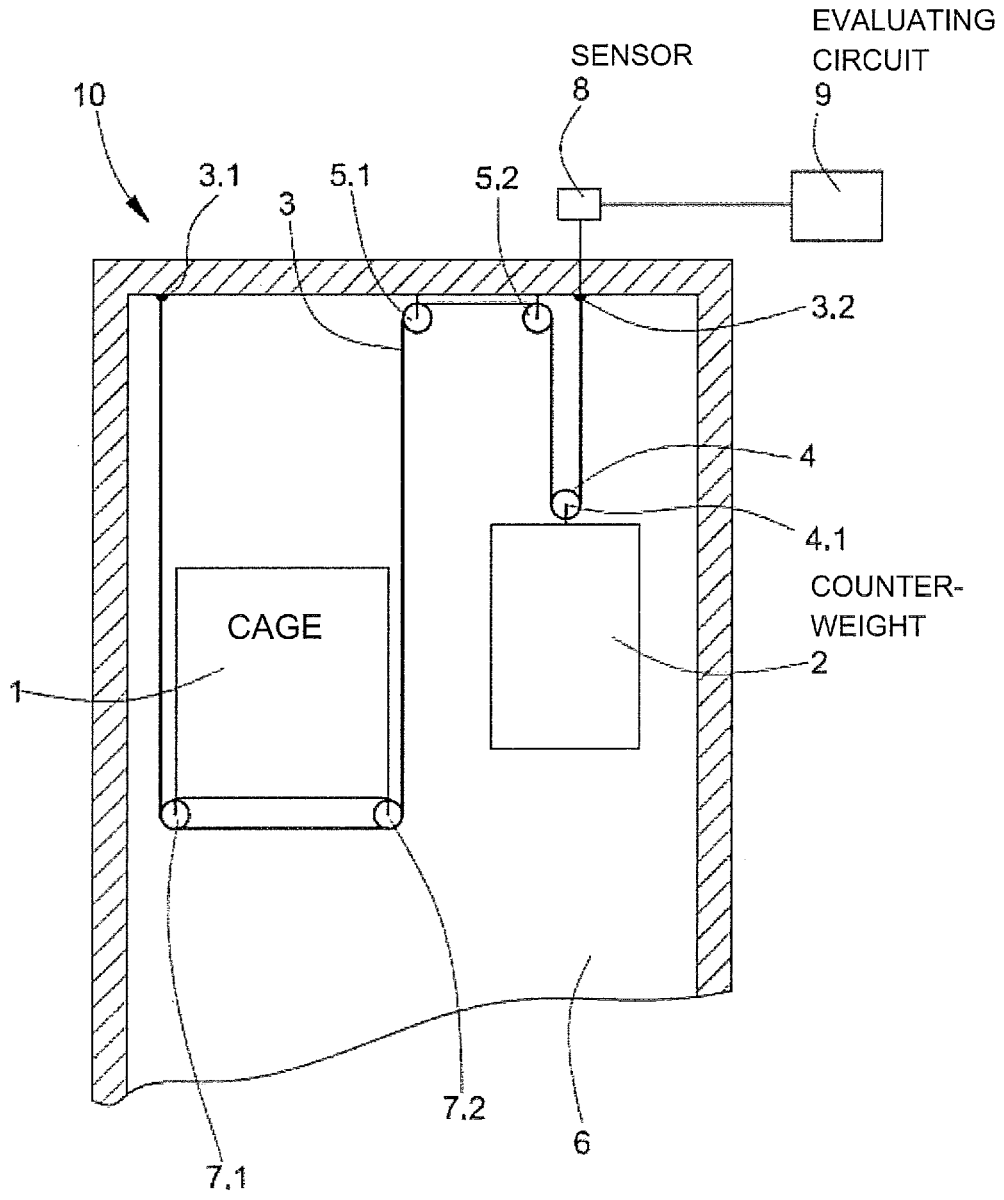
FIG. 1 shows an exemplifying form of embodiment of the elevator installation with a sensor for detecting vibrations generated by faulty functioning of an elevator component at the counterweight.

FIG. 1 shows an elevator installation 10. This elevator installation comprises a cage 1, a counterweight 2, a supporting and driving means 3, at which the cage 1 and the counterweight 3 are suspended in a 2:1 relationship and a drive pulley 5.1.

The drive pulley 5.1 is coupled with a drive unit, which is not illustrated in FIG. 1 for reasons of clarity, and is in operative contact with the supporting and driving means 3.

The cage 1 and the counterweight 2 are movable substantially along vertically oriented guide rails by means of a rotational movement of the drive pulley 5.1, which transmits a drive torque of the drive unit to the supporting and driving means 3. For reasons of clarity, the guide rails are not illustrated in FIG. 1. The cage 1 and the counterweight 2 are guided at the guide rails by means of guide elements such as, for example, guide shoes or guide rollers.

The counterweight 2 is in that case suspended in a first loop of the supporting and driving means 3. The first loop is formed by a part of the supporting and driving means 3 lying between a first end 3.2 of the supporting and driving means 3 and a deflecting roller 5.2. The counterweight 2 is suspended at the first loop by means of a bearing 4.1. The counterweight 2 is for that purpose coupled with the bearing 4.1. In the illustrated example the bearing 4.1 represents the fulcrum of a counterweight support roller 4. In that case, the supporting and/or driving means 3 extends from a first fixing point, at which the first end 3.2 of the supporting and/or driving means is fastened, downwardly to the counterweight support roller 4. The supporting and/or driving means 3 loops around the counterweight support roller 4 through approximately 180° and then extends upwardly to the first deflecting roller 5.2.

The cage 1 is suspended in a second loop of the supporting and/or driving means 3. The second loop is formed by a part of the supporting and/or driving means lying between a second end 3.1 of the supporting and/or driving means 3 and a second drive pulley 5.1. The cage 1 is suspended at the second loop by means of two cage support rollers 7.1, 7.2. In that case the supporting and/or driving means 3 extends from a second fixing point, at which the second end 3.1 of the supporting and/or driving means is fastened, downwardly to a first cage support roller 7.1. The supporting and/or driving means 3 loops around the first cage support roller 7.1 through approximately 90°, then extends substantially horizontally to a second cage support roller 7.2 and loops around the second cage support roller 7.2 by approximately 90°. In addition, the supporting and/or driving means 3 extends upwardly to the drive pulley 5.1. From the drive pulley 5.1 the supporting and/or driving means 3 finally runs to the first deflecting roller 5.2.

The two fixing points at which the first and second ends 3.2, 3.1 of the supporting and/or driving means 3 are fastened, the deflecting roller 5.2, the drive pulley 5.1 and the guide rails of the cage 1 and the counterweight 2 are coupled indirectly or directly to a supporting structure, typically shaft walls.

The first end 3.2 of the supporting and/or driving means 3 is coupled with a sensor 8. The sensor 8 detects solid-borne sound waves transmitted thereto by the supporting and/or driving means 3.

In an alternative form of embodiment the sensor 8 is coupled to a guide rail of the counterweight 2. In this regard, the sensor 8 detects solid-borne sound waves which the guide rail transmits to the sensor 8.

The solid-borne sound waves arise, during operation of the elevator installation 10, due to vibrations of movable elevator components. For example, vibrations occur due to the play between the guide elements of the cage 1 or the guide elements of the counterweight 2 and the corresponding guide rails, due to the drive unit, due to the play in the bearings of the deflecting roller 5.2, drive pulley 5.1, cage support rollers 7.1, 7.2 and counterweight support roller 4, and due to the vibrations of the supporting and driving means 3 itself.

In addition, vibrations can also be produced by movements of the cage and shaft doors, door drive and the like. Vibrations also occur at the bearing 4.1, at which the counterweight 2 is suspended, as well as at guide elements at which the counterweight 2 is guided at guide rails.

All above-mentioned components and further movable components which are not mentioned generate, in disturbance-free operation, vibrations lying in a characteristic frequency range and amplitude range. In the course of time, these elevator components are subject to wear phenomena which are reflected in a changed frequency range and amplitude range.

The positioning of the sensor 8 in the region of the elevator installation 10 is not limited to the arrangement, which is shown in the example, at the first end 3.2 of the supporting and/or driving means 3 and the detection of solid-borne sound waves. The positioning of the sensor 8 as well as the form of detection of vibrations, namely with regard to sonic waves or solid-borne sound waves, is oriented towards the components to be monitored and the design of the elevator installation 10, possibly the monitoring unit.

A sensor 8 designed for the purpose of detecting solid-borne sound waves is, for example, positionable at the second end 3.1 of the supporting and/or driving means 3. Solid-borne sound waves transmitted at the cage side by way of the supporting and/or driving means 3 are thereby detectable. The support rollers 7.1, 7.2 of the cage 1 or further components which are arranged at the cage 1 can thus be monitored.

Moreover, a sensor for monitoring the motor or further drive parts, such as transmission or drive pulley 5.1, is positionable at the motor housing in order to detect the vibrations generated by the components to be monitored.

Solid-borne sound waves are also detectable in the region of the cage 1, for example by sensors fastened to a door panel of a cage door, a housing of the door drive, a panel of a cage wall or a cage floor. In this way vibrations of movable components, such as the cage door, the cage support rollers 7.1, 7.2, the guide elements of the cage 1 or door drive are able to be measured.

Finally, movable components of a shaft door generate vibrations, which can be measured as, for example, solid-borne sound waves at the door panels of a shaft door. A sensor can, for detection of such solid-borne sound waves, possibly be arranged at a door panel.

A further group of sensors concerns sensors detecting sonic waves. Such sensors measure vibrations of components of the elevator installation, which are detectable as air-pressure waves. The arrangement of these sensors is possible within the entire region of the shaft space wherever the vibrations of the components are detectable as sonic waves.

A sensor 8 possibly detects sonic waves or solid-borne sound waves in a frequency range between 0 and 60,000 Hz, particularly between 0 and 2,500 Hz.

Figure 2:
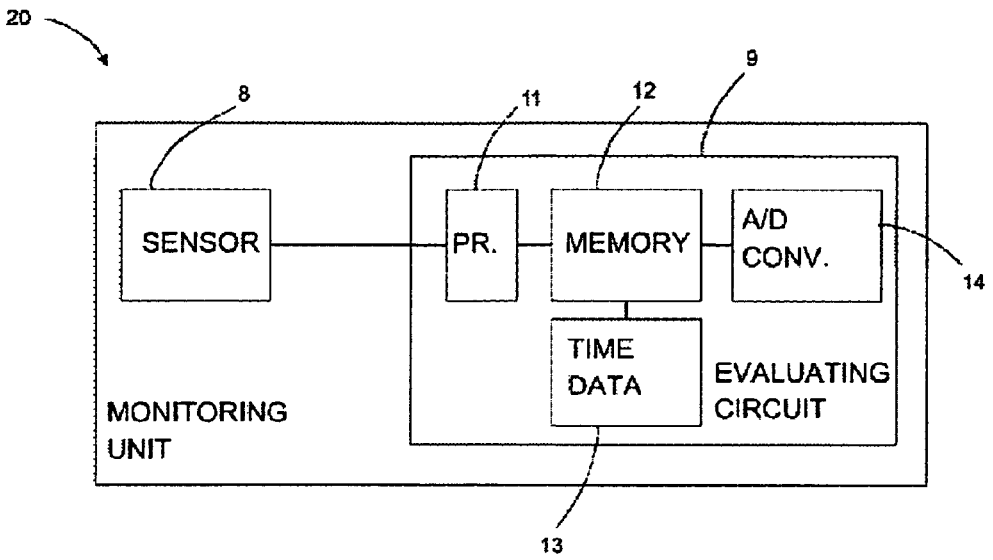
FIG. 2 shows a schematic illustration of the monitoring unit.

FIG. 2 shows a monitoring unit 20 comprising at least one sensor 8 and evaluating circuit 9. The sensor 8 transforms the detected sonic waves or solid-borne sound waves into a signal and transmits this signal to an evaluating circuit 9 by way of a signal transmission path, typically a signal line or a cable-free connection. This evaluating circuit 9 is provided for evaluation of the detected sonic waves or solid-borne sound waves.

The evaluating circuit 9 comprises at least one analog-to-digital converter 14, a processor 11, a memory unit 12 and a time data unit 13. Analog signals arriving from the sensor 8 are in that case firstly converted by the analog-to-digital converter 14 into a digital signal. This digital signal is communicated to the processor 11 and spectrally analyzed by this, possibly the frequencies and amplitudes of the transmitted sonic waves or solid-borne sound waves. The processor 11 determines frequency bands and establishes a measured signal intensity for each of these frequency bands. By frequency band there is to be understood here a frequency range, for example, a frequency range of 1,297 to 1,557 Hz (see FIG. 3). The signal intensity denotes a value dependent on the amplitude of the measured frequencies in this frequency band.

The processor 11 now establishes the measured signal intensity for each determined frequency band and compares this signal intensity in the frequency bands with a first signal intensity, which is filed for the corresponding frequency band in the memory unit 12, or a second signal intensity, which is filed for the corresponding frequency band in the memory unit 12 and which lies above the first signal intensity. The first signal intensity corresponds with the operating value and the second signal intensity with the threshold value.

The processor 11 counts the number of time steps in which the signal intensity in operation of the elevator installation reaches or exceeds the operating value and the number of time steps in which the signal intensity in operation of the elevator installation reaches or exceeds the threshold value. The statement of time steps necessary for that purpose is provided by the time data unit 13 to the processor 11.

Subsequently, the ratio of time steps with threshold value to time steps with operating value is determined in the processor 11 in a further evaluation. This ratio represents a quality characteristic of the vibrations. If this quality characteristic exceeds a defined critical quality characteristic then a change-of-state alarm is triggered. Occasional disturbances arising only for a short period of time or a few time steps are thus filtered out.

Figure 3:
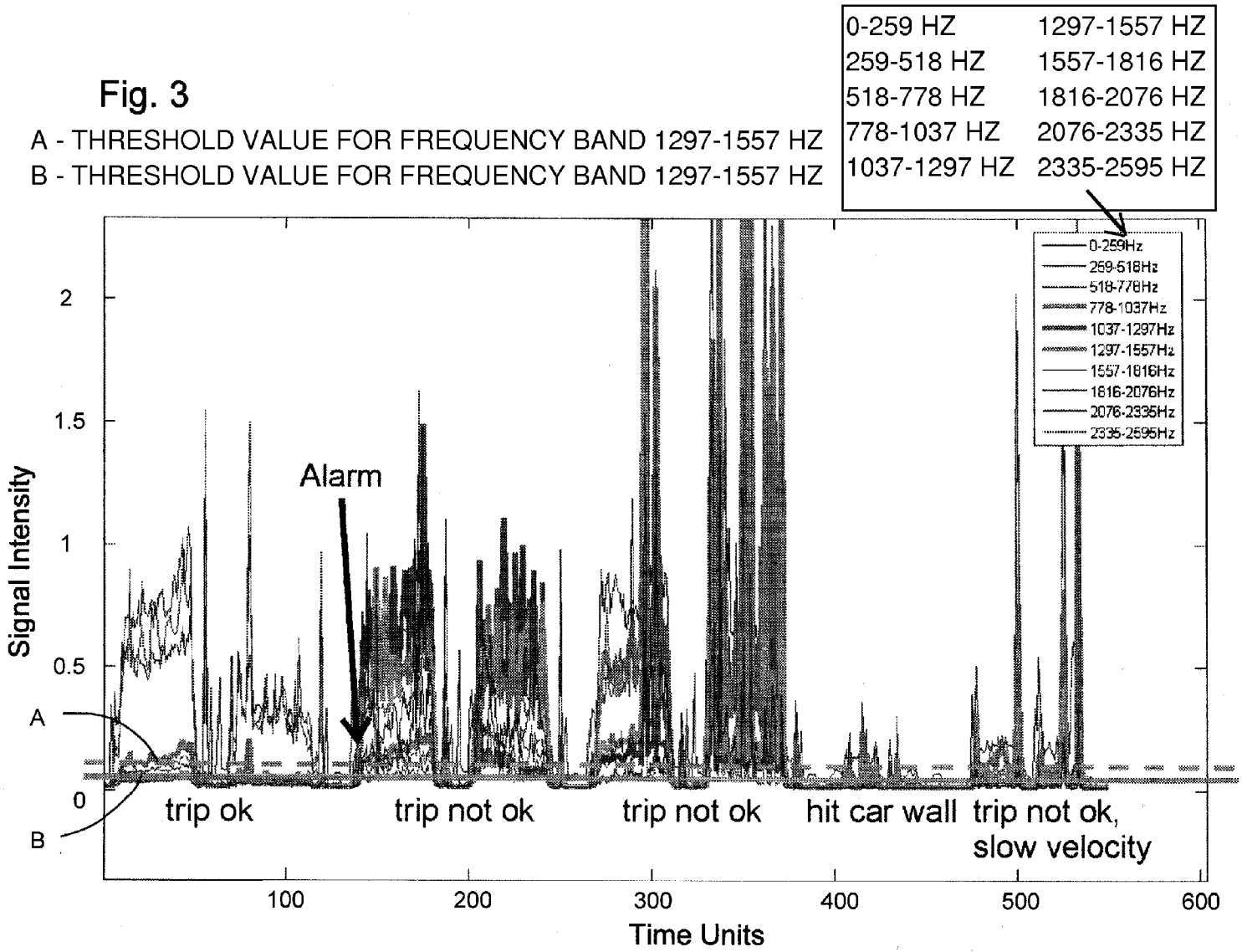
FIG. 3 shows a spectral analysis, by way of example, of vibrations detected by the sensor.

FIG. 3 shows an exemplifying evaluation of the vibrations. The measured frequencies are here divided up into ten frequency bands between 0 and 2,595 Hz. The signal intensity over time or time steps is recorded for each of these frequency bands. In FIG. 2 it is apparent that an operating value is predetermined for the frequency band 1,297-1,557 Hz. From this operating value a threshold value is calculated which here lies at, for example, 100% above the operating value. The threshold value can possibly be established at at least 10% above the operating value.

The signal intensity exceeds the permissible threshold value for the last-mentioned frequency band between the time steps 130 and 200, 200 and 250, 270 and 310, 315 and 380, 400 and 440 and 480 and 540. In the additional evaluation of the quality characteristic the critical quality characteristic is exceeded three times ("trip not ok"). A change-of-state alarm is triggered in these three cases. The signal intensity lies once above the threshold value. Since in this regard the calculated quality characteristic lies below the predetermined critical quality characteristic, no change-of-state alarm takes place. Exceeding of the threshold value is attributable to a single brief event, namely hitting against the side wall of the cage ("hit car wall"). This short event is filtered out by the additional evaluation of the quality characteristic.

The critical quality characteristic is here established at, for example, 10%. This means that of 100 time steps with a measured signal intensity lying above the operating value, 10 time steps with a measured signal intensity lying above the threshold value arise. Correspondingly, in the above-described evaluation the quality characteristic lies three times above the critical quality characteristic of 10% and the quality characteristic lies one below the critical quality characteristic of 10% notwithstanding exceeding of the threshold value.

The critical quality characteristic can possibly be fixed at at least 10%. In further embodiments the critical quality characteristic can also be fixed at at least 20, 30, 40 or 50%. The critical quality characteristic is possibly filed in the memory unit 12 of the evaluating circuit 9.

Figure 4:
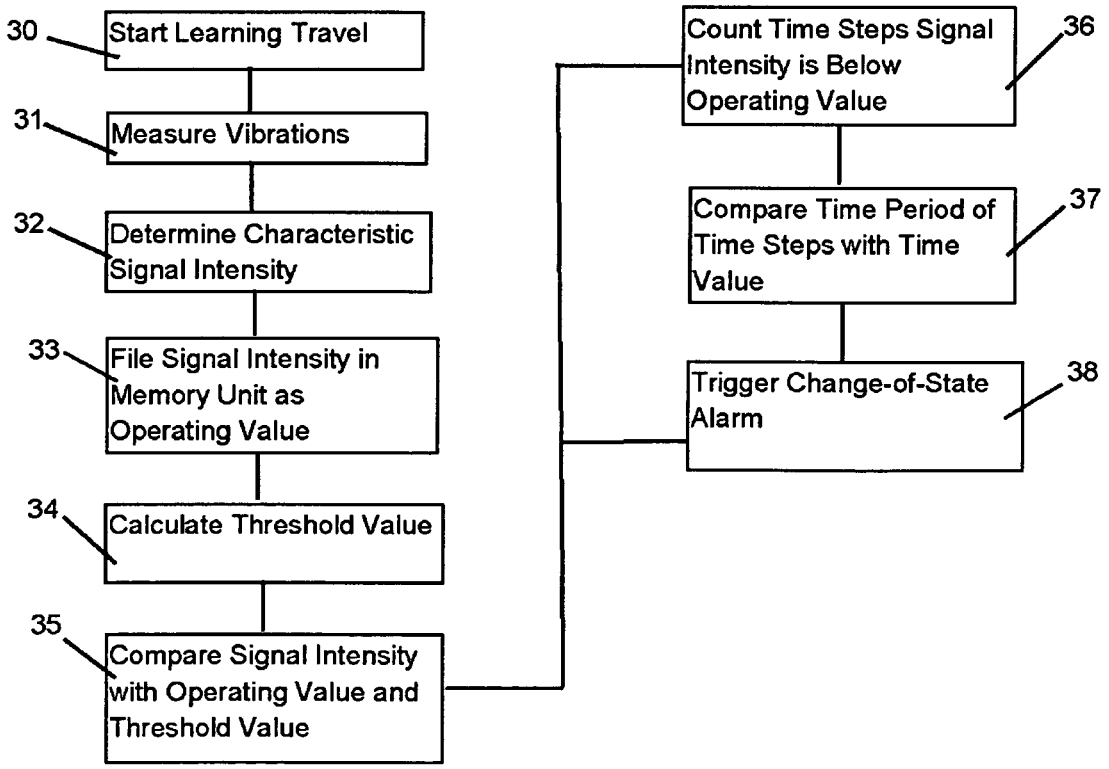
FIG. 4 shows a flow diagram of the elevator installation operating method according to the invention.

The elevator installation operation method is illustrated in FIG. 4. The operating value is possibly determined by means of learning travel (Step 30). During this learning travel the sensor 8 measures the vibrations which occur (Step 31). A characteristic signal intensity for each frequency band is determined therefrom in the evaluating circuit 9 or the processor 11, for example a maximum signal intensity or a mean signal intensity (Step 32). This signal intensity is then filed in the memory unit 12 of the evaluating circuit 9 as an operating value (Step 33). The threshold value can possibly be calculated from the operating value and represents a characteristic signal intensity increased by a certain percentage. This threshold value can be calculated in the processor 11 (Step 34). A comparison of the signal intensity with the operating value and the threshold value (Step 35) can trigger a change-of-state alarm (Step 38).

A further evaluation of the vibrations relates to self-testing of the sensor 8 or the signal transmission path. The evaluating circuit 9 or the processor 11 for that purpose counts the time steps in which the signal intensity does not reach the operating value (Step 36). These time steps represent a time period in which the elevator installation 10 is stationary. The processor 11 checks whether this time period exceeds a specific time value. For that purpose the processor 11 compares the time period with a time value filed in the control unit. If the processor 11 ascertains exceeding of this time value, then faulty functioning of the sensor is assumed (Step 37). This time value is calculated on the basis of a characteristic use profile of the elevator installation 10 and represents a time period in which the elevator installation 10 would, with very high probability, have had to have been used. If this time value, is exceeded, a change-of-state alarm is similarly triggered (Step 38).

The triggering of the change-of-state alarm has the consequence that the elevator installation 10 is provided for a maintenance operation, in which the operational disturbance of the elevator installation 10 is eliminated. For example, an alarm is communicated to a service center, which instructs a service engineer to service the corresponding elevator installation 10. Alternatively, when a change-of-state alarm is triggered the service engineer is directly notified by way of a mobile radio receiving system connected with the elevator installation to service the corresponding elevator installation 10.

For reasons of safety the elevator installation may also be stopped when a change-of-state alarm occurs. In this case, a service engineer is similarly instructed to service the elevator installation and place it back in operation.

The detection of vibrations by the sensor 8 and evaluation of those in the evaluating circuit 9 according to the above procedure is not restricted to the illustrated configuration of the elevator installation 10. Thus, monitoring of the vibrations of movable components also relates to elevator installation with a suspension ratio of 1:1, 3:1, etc., elevator installations without a counterweight, elevator installations with an engine room or in general elevator installations in which movable components cause vibrations.

In departure from the illustrated example in FIG. 1 it is also possible to simultaneously position, at different places of the elevator installation, several sensors which have a common evaluating circuit, are allocated in groups to an evaluating circuit or each have an own evaluating circuit.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator installation, comprising:

a sensor that detects vibrations generated during operation of the elevator installation; and an evaluating circuit, connected to the sensor, that compares the detected vibrations with a predeterminable operating value and with a predeterminable threshold value, wherein the evaluating circuit calculates a quality characteristic based on the comparisons of the detected vibrations with the predeterminable operating value and with the predeterminable threshold value, the quality characteristic being further based on a ratio between a time period in which the predeterminable threshold value is reached or exceeded and a time period in which the predeterminable operating value is reached or exceeded.

2. The elevator installation of claim 1, further comprising a processor that triggers a change-of-state alarm if a critical quality characteristic is exceeded.

3. The elevator installation of claim 1, further comprising a processor that triggers a state-of-change alarm if the detected vibrations fall below the predetermined operating value during a predeterminable time period.

4. The elevator installation of claim 3, the predeterminable time period being at least one hour.

5. The elevator installation of claim 1, the predeterminable operating value having been established by a learning travel of the elevator installation.

6. An elevator installation operation method, comprising:

detecting, using a sensor, vibrations generated during operation of an elevator installation; and evaluating the detected vibrations using an evaluating circuit connected with the sensor, the evaluating comprising comparing the detected vibrations with a predeterminable operating value and with a predeterminable threshold value, further comprising calculating, using the evaluating circuit, a quality characteristic from the comparison of the detected vibrations with the predetermined operating value and with the predetermined threshold value, the calculating the quality characteristic comprising determining a ratio between a time period in which the predeterminable threshold value is reached or exceeded and a time period in which the predeterminable operating value is reached or exceeded.

7. The elevator installation operation method of claim 6, further comprising triggering a change-of-state alarm when a critical quality characteristic is exceeded.

8. The elevator installation operation method of claim 6, further comprising triggering a change-of-state alarm when the detected vibrations fall below the predetermined operating value during a predeterminable time period.

9. The elevator installation operation method of claim 8, the predeterminable time period being at least one hour.

10. The elevator installation operation method of claim 6, the predeterminable operating value having been established using a learning travel of the elevator installation.

* * * * *